United States Patent [19]

Sawada et al.

[11] Patent Number: 4,730,206

[45] Date of Patent: Mar. 8, 1988

[54] COPYING APPARATUS HAVING A SHEET REFEEDING DEVICE

[75] Inventors: Shigeru Sawada; Masaru Komura, both of Toyokawa; Masazumi Ito, Toyohashi; Masaaki Oyabu, Aichi, all of Japan

[73] Assignee: Minolta Camera Kabushiki Kaisha, Osaka, Japan

[21] Appl. No.: 7,794

[22] Filed: Jan. 28, 1987

[30] Foreign Application Priority Data

Jan. 19, 1986 [JP] Japan ..... 61-18515
Jan. 29, 1986 [JP] Japan ..... 61-18501
Jan. 29, 1986 [JP] Japan ..... 61-18502
Jan. 29, 1986 [JP] Japan ..... 61-18503

[51] Int. Cl.[4] ..... G03G 15/00

[52] U.S. Cl. ..... 355/3 SH; 355/14 SH; 355/24; 271/279

[58] Field of Search ..... 355/3 SH, 14 SH, 23, 355/24, 25; 271/3.1, 279, 280

[56] References Cited

U.S. PATENT DOCUMENTS 3,972,612 8/1976 Komori et al. ..... 355/26
4,017,173 4/1977 Komori et al. ..... 355/8
4,190,354 2/1980 Smith et al. ..... 355/24 X
4,272,180 6/1981 Satomi et al. ..... 355/24 X
4,537,497 8/1985 Masuda ..... 355/14 R
4,580,890 4/1986 Sugizaki et al. ..... 355/3 SH X
4,671,644 6/1987 Sumida et al. ..... 355/3 SH X

FOREIGN PATENT DOCUMENTS 134659 8/1983 Japan .

*Primary Examiner*—A. C. Prescott
*Attorney, Agent, or Firm*—Burns, Doane Swecker & Mathis

[57] ABSTRACT

A copying apparatus including a recording module for forming an image on copy paper sheets fed from a sheet feeding portion and discharging the copy paper sheets to a sheet ejecting portion and a sheet processing module mounted detachably on the sheet ejecting portion. The sheet processing module includes a sheet cassette mounted detachably on the sheet processing module and the sheet feeding portion, a copy receiving tray and a changeover device for changing over to the sheet cassette or the copy receiving tray, a passage of the copy paper sheets discharged from the sheet ejecting portion.

27 Claims, 27 Drawing Figures

COPYING APPARATUS HAVING A SHEET REFEEDING DEVICE

BACKGROUND OF THE INVENTION

The present invention generally relates to copying apparatuses and more particularly, to a copying apparatus in which copy paper sheets ejected out of an apparatus housing of the copying apparatus are received so as to be refed and a sheet feeding portion of the copying apparatus into the apparatus housing.

Generally, in order to perform duplex copying or composite copying in copying apparatuses, one copy paper sheet is required to be fed twice. To this end, various copying apparatuses have been processed. For example, in order to simplify operations of duplex copying in a copying apparatus having a U-shaped sheet feeding passage, U.S. Pat. No. 4,017,173 proposes a sheet refeeding device in which an upper sheet cassette movable between a sheet ejecting portion and a sheet feeding portion is displaced, at the time of copying onto a front surface of a copy paper sheet, to the sheet ejecting portion so as to receive the copy paper sheet and is displaced, at the time of copying onto a back surface of the copy paper sheet, to the sheet feeding portion so as to refeed the copy paper sheet.

Meanwhile, Japanese Patent Laid-Open Publication No. 134659/1983 discloses a sheet refeeding device for a copying apparatus having a straight pass type sheet feeding passage, in which a sheet cassette having a sheet receiving opening and a sheet feeding opening is detachably mounted on a sheet ejecting portion and a sheet feeding portion upon turnover of front and back surfaces of copy paper sheets.

However, in the known sheet refeeding devices referred to above, since the upper sheet cassette or the sheet cassette itself is displaced from the sheet ejecting portion to the sheet feeding portion, another copy receiving tray is required to be additionally provided at the sheet ejecting portion at the time of copying onto the back surfaces of the copy paper sheets. Furthermore, the known sheet refeeing devices have such a drawback that the upper sheet cassette and the sheet cassette are designed for exclusive use in the known copying apparatuses, respectively and therefore, cannot be provided, as options, in other existing copying apparatuses having no sheet refeeding device.

SUMMARY OF THE INVENTION

Accordingly, an essential object of the present invention is to provide a copying apparatus having a sheet refeeding device, which eliminates the disadvantages inherent in conventional copying apparatuses.

In order to accomplish this object of the present invention, a copying apparatus embodying the present invention comprises: a recording module which forms an image on copy paper sheets fed from a sheet feeding portion and discharges the copy paper sheets to a sheet ejecting portion; and a sheet processing module which is detachably mounted on said sheet ejectiong portion; said sheet processing module comprising: a sheet cassette for accommodating the copy paper sheets, which is detachably mounted on said sheet processing module and said sheet feeding portion; a copy receiving tray; and a changeover means for changing over to said sheet cassette or said copy receiving tray, a passage of the copy paper sheets discharged from said sheet ejecting portion.

BRIEF DESCRIPTION OF THE DRAWINGS

This object and features of the present invention will become apparent from the following description taken in conjunction with the preferred embodiments thereof with reference to the accompanying drawings; in which.

Before the description of the present invention proceeds, it is to be noted like parts are designated by like reference numerals throughout several views of the accompanying drawings.

DETAILED DESCRIPTION OF THE INVENTION

Figure 1:
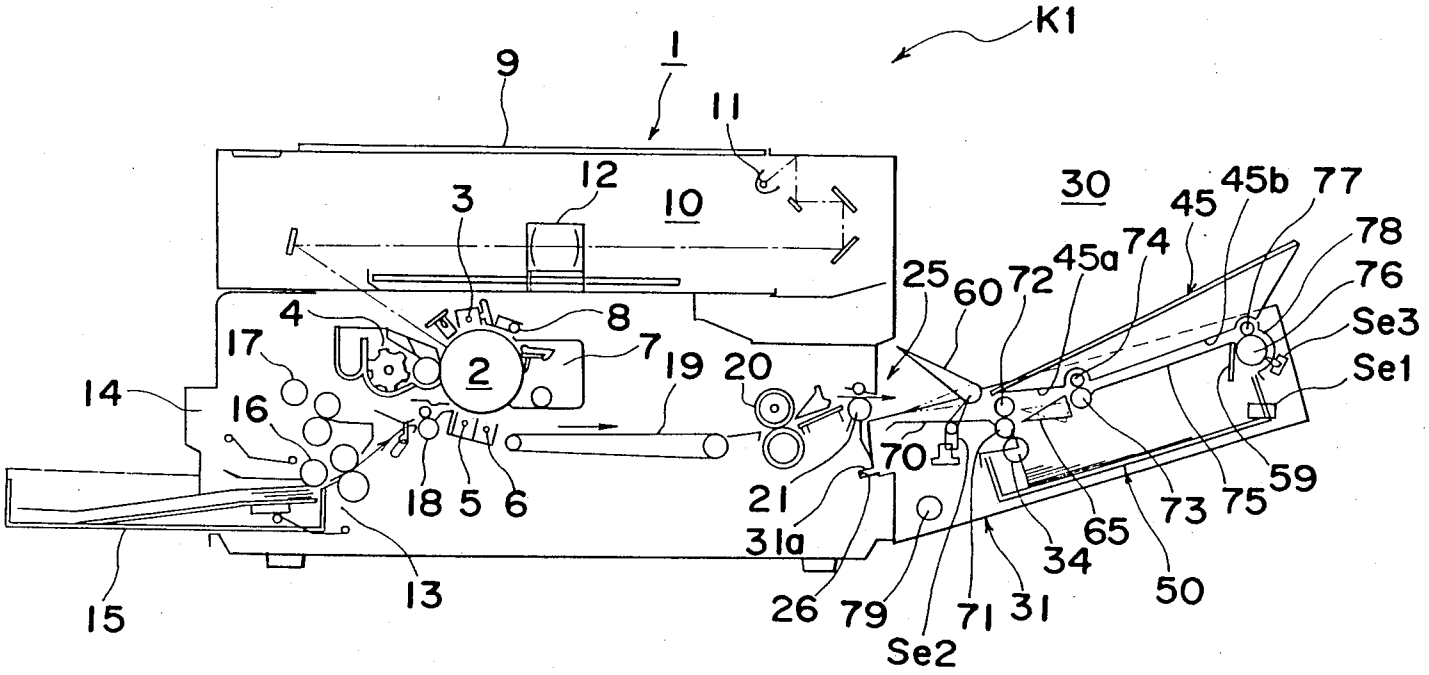
FIG. 1 is a schematic sectional view of a copying apparatus provided with a sheet refeeding device, according to a first embodiment of the present invention.

Referring now to the drawings, there is shown in FIGS. 1 to 7, a copying apparatus K1 according to a first embodiment of the present invention. As shown in FIG. 1, the copying apparatus K1 having an apparatus housing 1 includes a sheet ejecting portion 25 and a sheet refeeding device 30 detachably mounted on the sheet ejecting portion 25. The copying apparatus K1 further is of a transfer type employing a known movable optical system and includes a photosensitive drum 2 driven for rotation in the counterclockwise direction in FIG. 1, around which a corona charger 3, a developing device 4 of a magnetic brush type, a transfer charger 5, a charge eraser 6 for separating copy paper sheets from the photosensitive drum 2, a cleaning device 7 for removing residual toner from the surface of the photosensitive drum 2 and an eraser lamp 8 for removing residual electric charge from the surface of the photosensitive drum 2 are sequentially provided. An image of an original document placed on an original platform 9 made of glass is exposed, by an optical system 10 movable in the leftward direction in FIG. 1, at an exposure portion of the photosensitive drum 2, which exposure portion is disposed between the corona charger 3 and the developing device 4.

Copy paper sheets are selectively fed into the apparatus housing 1 one sheet by one sheet through rotation of a sheet feeding roller 16 or 17 from a sheet feeding cassette 15 loaded into a sheet feeding portion 13 or 14 and are conveyed to a transfer portion synchronously with a leading edge of a toner image on the photosensitive drum 2 by two engaged register rollers 18 such that the toner image is transferred onto the copy paper sheet by the transfer charger 5. Thereafter, the copy paper sheet having the toner image is fed from a transport belt 19 to a fixing device 20 such that the toner image on the copy paper sheet is fixed by the fixing device 20. Then, the copy paper sheet having the toner image fixed thereon is discharged from the sheet ejecting portion 25 by two engaged outlet rollers 21.

The sheet refeeding device 30 is provided for receiving the copy paper sheet discharged from the sheet ejecting portion 25 and is substantially constituted by a body portion 31, a copy receiving tray 45, a sheet refeeding cassette 50 and changeover claws 60 and 65 for changing over passages of the copy paper sheets.

Figure 2:
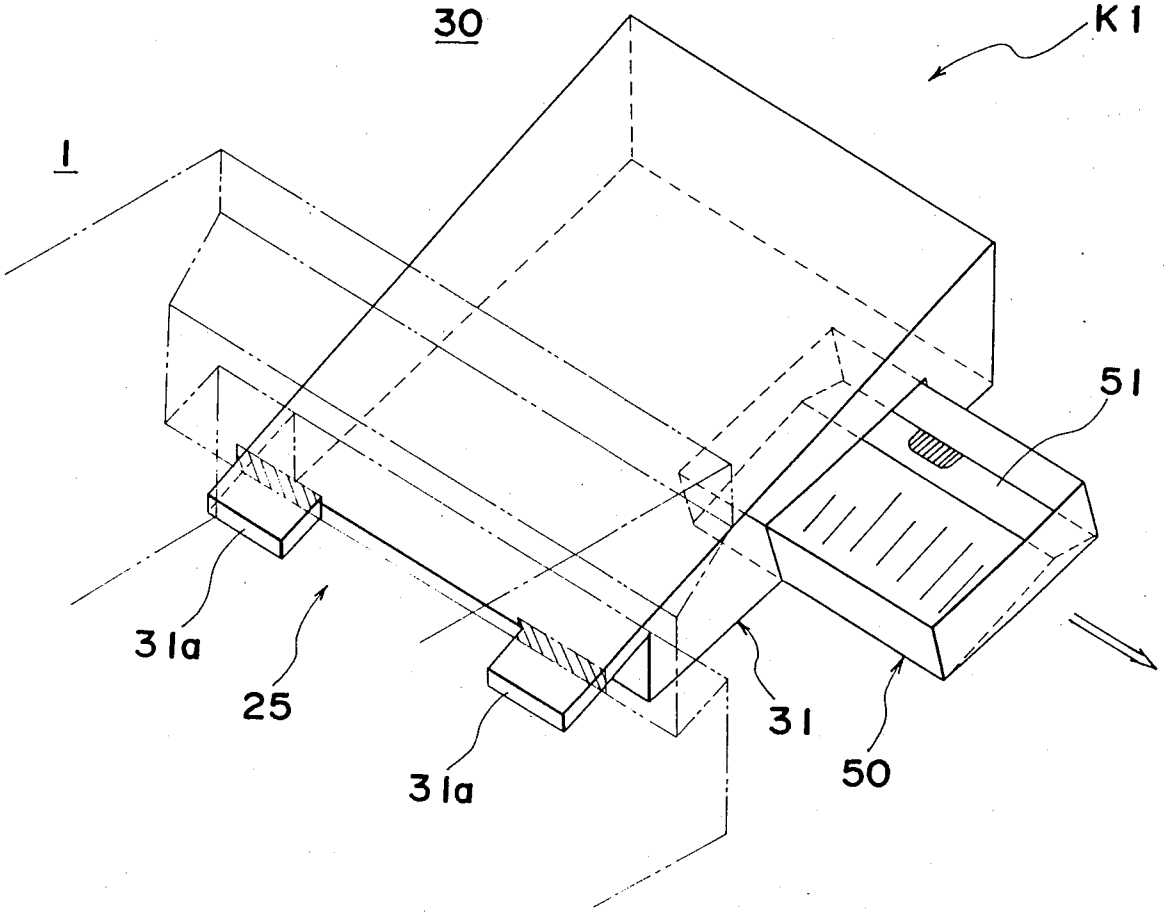
FIG. 2 is a perspective view explanatory of mounting and dismounting of a sheet refeeding cassette employed in the sheet refeeding device of FIG. 1.

As shown in FIG. 2, the body portion 31 has a pair of lugs 31a formed at a front end thereof. The body portion 31 is loaded into the sheet ejecting portion 25 by inserting the lugs 31a into a pair of slots 26 (FIG. 1) formed at the sheet ejecting portion 25. The slots 26 are essentially designed for loading thereinto a copy receiving tray (not shown). A bottom wall of the body portion 31 is inclined such that the body portion 31 can also be mounted on a sorter (not shown). The copy receiving tray 45 is made of transparent synthetic resin and is proivded at an upper face of the body portion 31 so as to receive the copied copy paper sheets discharged from the apparatus housing 1.

Figure 3:
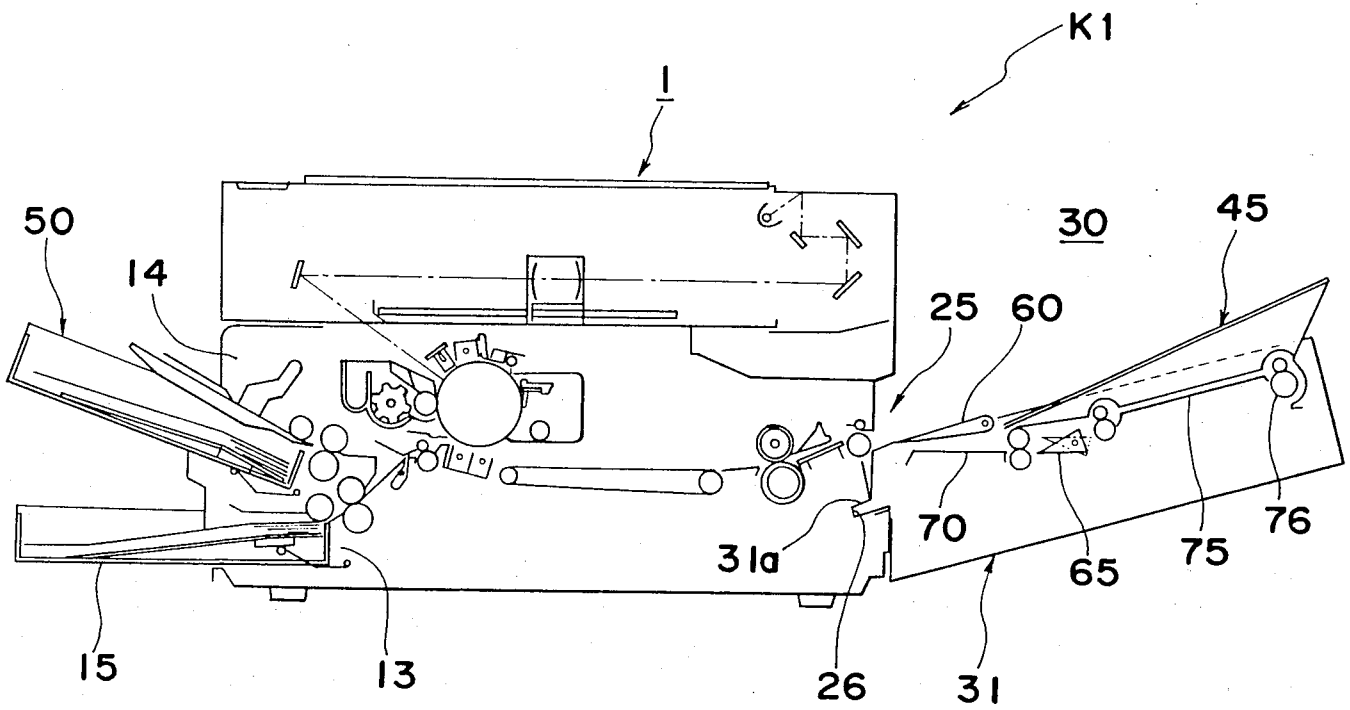
FIG. 3 is a schematic sectional view showing mounting of the sheet refeeding cassette on a sheet feeding portion of the copying apparatus of FIG. 1.
Figure 4:
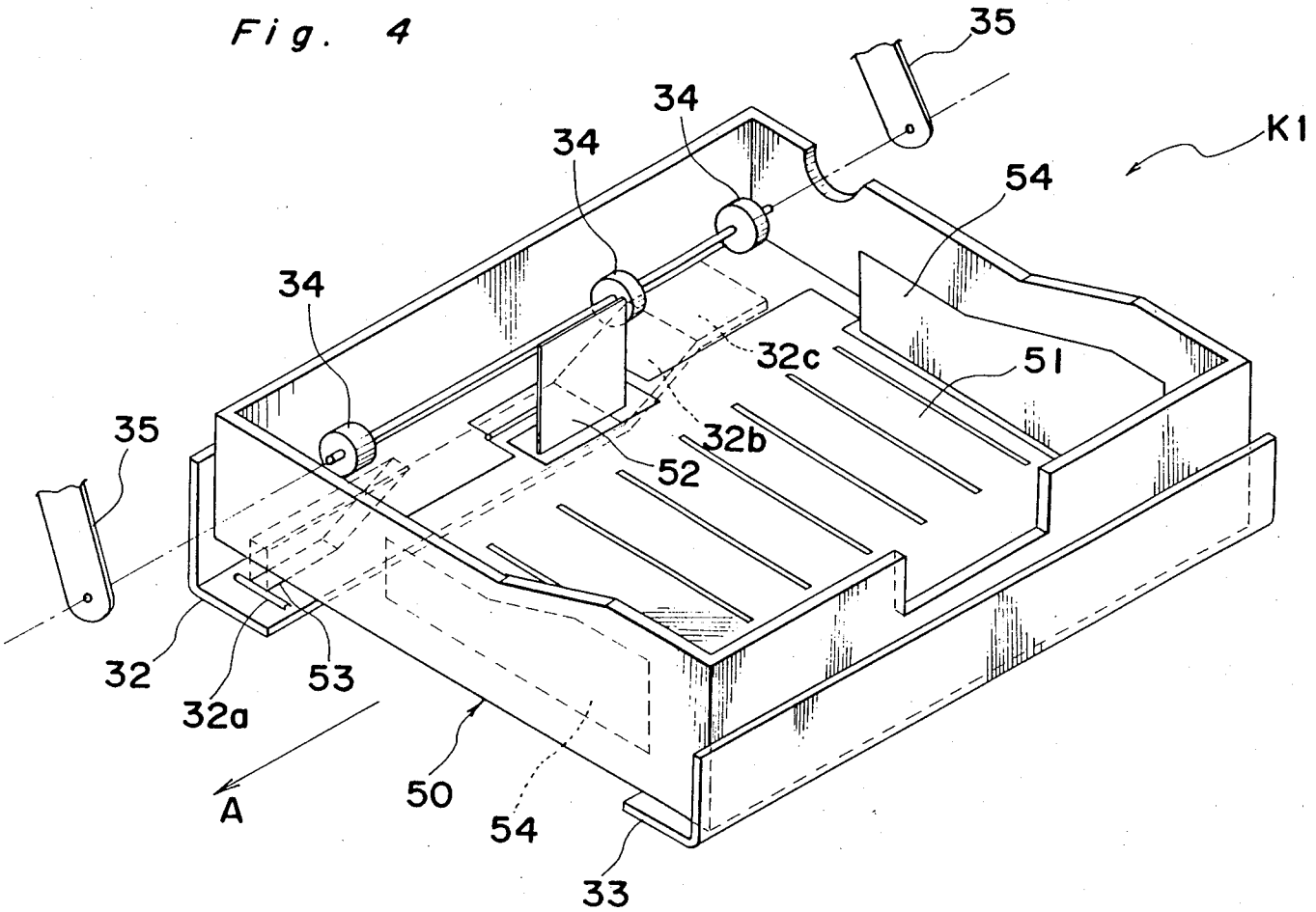
FIGS. 4 and 5 are a perspective view and a sectional view of the sheet refeeding cassette of FIG. 2, respectively.
Figure 5:
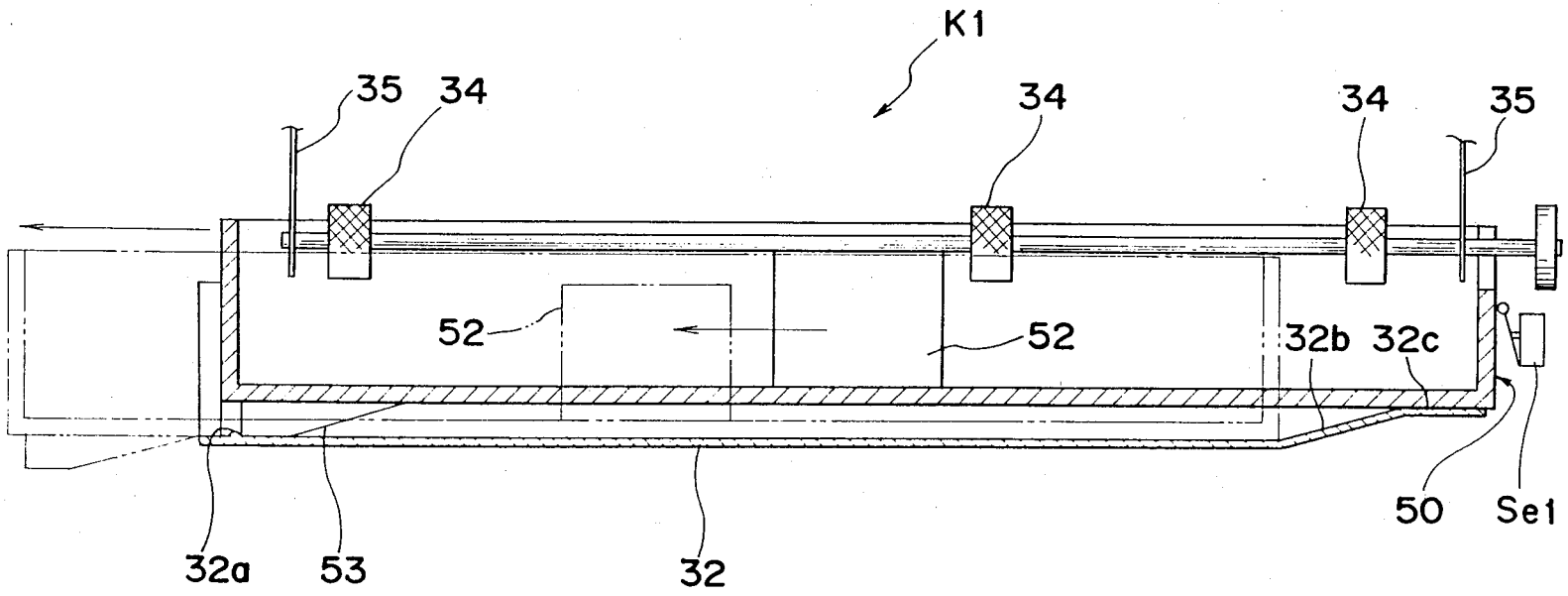

The sheet refeeding cassette 50 has a substantially boxlike shape as shown in FIG. 4 and is slidably loaded into the body portion 31 from the front side of the copyiing apparatus K1 as shown in FIG. 2. The sheet refeeding cassette 50 is fundamentally the same, in construction, as the sheet feeding cassette 15 referred to earlier. The sheet refeeding cassette 50 has a bottom plate 51 and a rear plate 52. The bottom plate 51 is pivotally provided so as to be vertically pivoted about its portion adjacent to the rear plate 52. After the sheet refeeding cassette 50 has been withdrawn from the body portion 31, the sheet refeeding cassette 50 is loaded into the sheet feeding portion 13 or 14 so as to refeed the copy paper sheets accommodated therein. FIG. 3 illustrates a state in which the sheet refeeding cassette 50 is loaded into the sheet feeding portion 14. Meanwhile, as shown in FIG. 4, the sheet refeeding cassette 50 is slidable on guide plates 32 and 33 provided on the body portion 31. A forward end of the sheet refeeding cassette 50 is positioned through its contact with a side plate of the body portion 31, while a rearward end of the sheet refeeding cassette 50 having a leg piece 53 provided on its lower face is positioned and retained through contact of the leg piece 53 with a projection **32*a* provided on the guide plate 32. The guide plate 32 is formed, at its forward end portion, with an inclined face 32*b* and an upper step portion 32*c*. The sheet refeeding cassette 50 further includes a plurality of press rollers 34 for pressing edges of the copy paper sheets and a pair of support plates 35 for supporting the press rollers 34. When the sheet refeeding cassette 50 is withdrawn from the body portion 31 in the direction of the arrow A in FIG. 4, the sheet refeeding cassette 50 falls down from the upper step portion 32*c* so as to be set in an oblique state such that the rear plate 52 is brought out of contact with the press roller 34 and the support plate 35 which are disposed adjacent to the rearward end portion of the sheet refeeding cassette 50. Furthermore, a sensor Sel for detecting loading and unloading of the sheet refeeding cassette 50 is provided at a forward end portion of the body portion 31 (see FIG. 5**).

As shown in FIG. 1, feed passages of the copy paper sheets are defined by a first changeover claw 60, a guide plate 70 for guiding the copy paper sheets to the sheet refeeding cassette 50, a driving roller 71, a driven roller 72, a second changeover claw 65, a driving roller 73, a driven roller 74, a guide plate 75, a turnover roller 76, a driven roller 77 and a circular guide plate 78 extending partially around the turnover roller 76. Lower face portions **45*a* and 45*b* of the copy receiving tray 45 also function as a guide plate. Furthermore, in order to easily deal with jam of the copy paper sheets occurring below the copy receiving tray 45, the copy receiving tray 45 is detachably mounted on the body portion 31. The driving rollers 71 and 73 and the turnover roller 76 are driven for rotation thereof in the clockwise direction in FIG. 1 by a motor 79 provided in the body portion 31. The above described press rollers 34 are also driven for rotation thereof in the clockwise direction in FIG. 1 by the motor 79**.

Figure 6A:
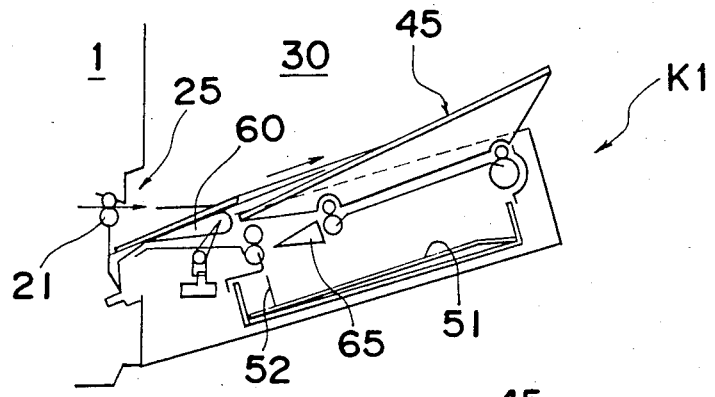
FIGS. 6A to 6C are sectional views explanatory of changeover of feed passages of the sheet refeeding device of FIG. 1.
Figure 6B:
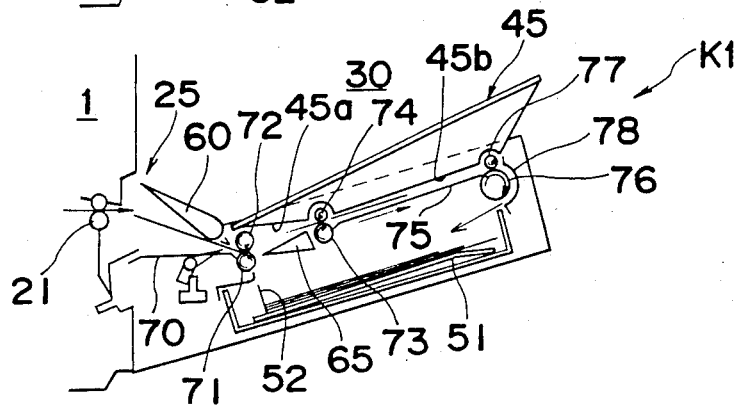
Figure 6C:
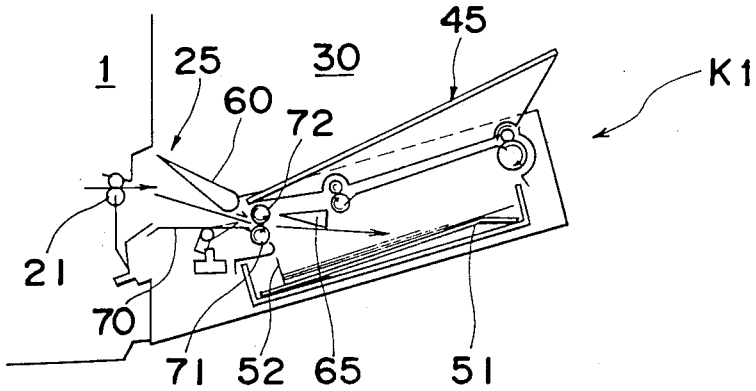

Each of the changeover claws 60 and 65 can be changed over to a position shown by solid lines and a position shown by two-dot chain lines by an operating lever 80 (shown in FIG. 7) to be described below. The sheet refeeding device 30 has three sheet feeding modes, i.e. a copy receiving tray mode for feeding the copy paper sheets to the copy receiving tray 45, a duplex copying mode for performing duplex copying and a composite copying mode for performing composite copying. In the copy receiving tray mode, the first changeover claw 60 is set at its lower position as shown in FIG. 6A such that the copy paper sheet discharged from the outlet rollers 21 is guided by an upper face of the first changeover claw 60 so as to be carried onto the copy receiving tray 45. In the duplex copying mode, the first changeover claw 60 is set at its upper position and the second changeover claw 65 is set at its lower position as shown in FIG. 6B. At this time, the copy paper sheet is guided by a lower face of the first changeover claw 60 and the guide plate 70 so as to be transported in the rightward direction in FIG. 6B by the rollers 71 to 74 and is guided by an upper face of the second changeover claw 65, the guide plate 75, the lower face portions **45*a* and 45*b* of the sheet receiving tray 45. Subsequently, the copy paper sheet is turned over through guide of the guide plate 78 by the turnover roller 76 and the driven roller 77 such that the copied face of the copy paper sheet is oriented downwardly and then, the copy paper sheet having the copied face oriented downwardly is fed into the sheet refeeding cassette 50 in the leftward direction from the turnover roller 76. Meanwhile, in the composite copying mode, the first changeover claw 60 and the second changeover roller 65 are set at their upper positions, respectively as shown in FIG. 6C. The copy paper sheet is guided by the lower face of the first changeover claw 60 and the guide plate 70 so as to be conveyed by the rollers 71 and 72 and then, is guided by a lower face of the second changeover claw 65 into the sheet refeeding cassette 50 in the rightward direction from the second changeover claw 65, with the copied face of the copy paper sheet being oriented upwardly. Accordingly, the copy paper sheets having copied faces oriented downwardly and upwardly and stacked in the sheet refeeding cassette 50 and are refed from the sheet refeeding cassette 50 by loading the sheet refeeding cassette 50 into the sheet feeding portion 13 or 14 after withdrawal of the sheet refeeding cassette 50 from the body portion 31**, so that duplex copying or composite copying is performed.

Meanwhile, the copied face of the copy paper sheet discharged from the apparatus housing 1 is oriented upwardly and can be visually inspected by an operator during transport of the copy paper sheet at the first changeover claw 60. Especially, since the copy receiving tray 45 is made of transparent material as described earlier, the copy paper sheet being transported on the guide plate 75 can be visually inspected even in the case of duplex copying mode.

On the other hand, in the above described feed passages of the copy paper sheet, there are provided a copy paper detection sensor Se2 having an actuator projecting above the guide plate 70 and a jam detection sensor Se3 having an actuator projecting from the guide plate 78 towards the turnover roller 76 as shown in FIG. 1. The sensor Se2 detects the copy paper sheet discharged to the sheet refeeding cassette 50 so as to actuate a counter for counting the number of the copy paper sheets discharged to the sheet refeeding cassette 50. Furthermore, the sensor Se2 not only actuates the motor 79 upon its detection of the leading edge of the copy paper sheet but actuates a timer upon its detection of the trailing edge of the copy paper sheet such that operation of the motor 79 is stopped upon lapse of a preset time of the timer, namely upon lapse of a time period during which the copy paper sheet is completely accommodated in the sheet refeeding cassette 50. Meanwhile, the sensor Se3 is arranged to detect jam of the copy paper sheets due to winding of the copy paper sheets around the turnover roller 76, etc.

Meanwhile, in the body portion 31, a "Mylar" (name used in trade and manufactured by Du Pont of the U.S.) plate 59 is provided adjacent to the turnover roller 76. The Mylar plate 59 is provided for retaining the trailing edge of the copy paper sheet fed from the turnover roller 76 to the sheet refeeding cassette 50 in the duplex copying mode so as to prevent the trailing edge of the copy paper sheet from being curled upwardly due to heat curling. On the other hand, upward curling of the leading edge of the copy paper sheet due to heat curling is prevented by clockwise rotation of the press rollers 34 referred to earlier.

Then, operations of the changeover claws 60 and 65 are described with reference to FIGS. 7A to 7C. Initially, the first changeover claw 60 is rotatably supported by a support shaft 61, while the second changeover claw 65 is secured to a support shaft 66 so as to be rotated together with the support shaft 66. The operating lever 80 is rotatably supported by a support shaft 81 at the front side of the body portion 31. An intermediate lever 82 is rotatably supported, at its one end, by a support shaft 83 and has an upper circular portion **82*a* and a lower circular portion 82*b* which define coaxial arcs having the support shaft 81 of the operating lever 80 as the center. A pin 60*a* fixed to the first changeover claw 60 is brought into contact with the upper circular portion 82*a*. Meanwhile, the lower circular portion 82*b* is formed with recesses 82*c* and 82*d* engageable with a pin 80*a* secured to the operating lever 80. A link 84 is coupled, at its one end, with the operating lever 80 and is formed, at the other end, with an elongated guide opening 84*a* in which a pin 85*a* of a link 85 secured to the support shaft 66 of the second changeover claw 65** is loosely fitted.

Figure 7A:
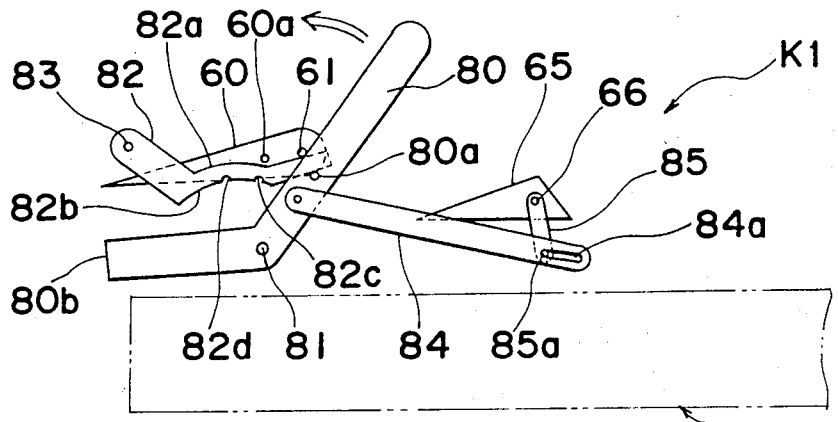
FIGS. 7A to 7C are views explanatory of operations of changeover claws employed in the sheet refeeding device of FIG. 1.

In the copy receiving tray mode, the the operating lever 80 is rotated to the position shown in FIG. 7A and the intermediate lever 82 is held in contact, at a lower face of its distal end portion, with the pin **80*a*, so that the first changeover claw 50 is disposed at the lower position shown by the two-dot chain lines in FIG. 1. Meanwhile, the pin 85*a* of the link 85 is disposed at the left end of the guide opening 84*a* of the link 84 and thus, the second changeover claw 65 is also disposed at the lower position shown by the solid lines in FIG. 1. In this case, since a lower end portion 80*b* of the operating lever 80 is retracted upwardly from a passage of the sheet refeeding cassette 50, the sheet refeeding cassette 50 can be withdrawn from the body portion 31**.

Figure 7B:
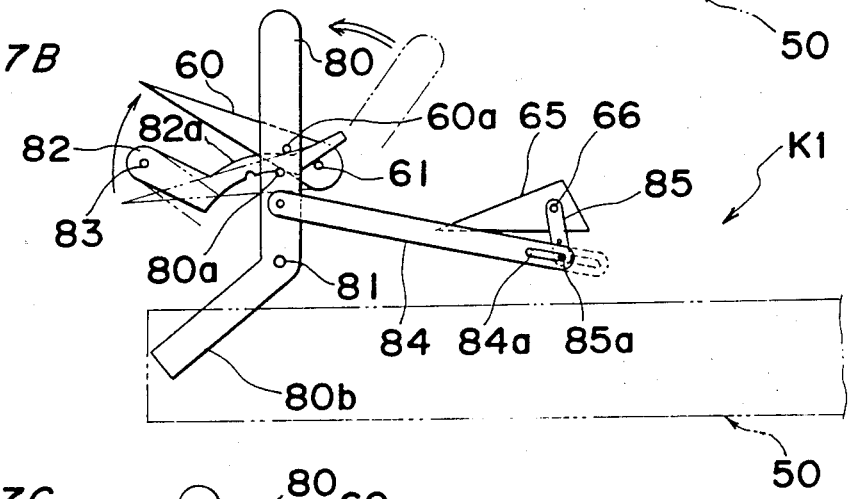

In order to change over the copy receiving tray mode to the duplex copying mode, the operating lever 80 is rotated to the vertical position shown in FIG. 7B. At this time, the operating lever 80 is retained at the vertical position through engagement of the pin **80*a* with the recess 82*c* of the intermediate lever 82. The intermediate lever 82 is rotated slightly upwardly about the support shaft 83 and thus, the first changeover claw 60 whose pin 60*a* is engaged with a right end portion of the circular portion 82*a* is rotated to the upper position shown by the solid lines in FIG. 1. At the same time, the link 84 is displaced leftwards by the operating lever 80 through a length of the guide opening 84*a*. Thus, the second changeover claw 65 is held at the lower position. Meanwhile, the lower end portion 80*b* of the operating lever 80 is projected into the passage of the sheet refeeding cassette 50 so as to lock the sheet refeeding cassette 50 such that mounting and dismounting of the sheet refeeding cassette 50 are prevented by the lower end portion 80*b***.

Figure 7C:
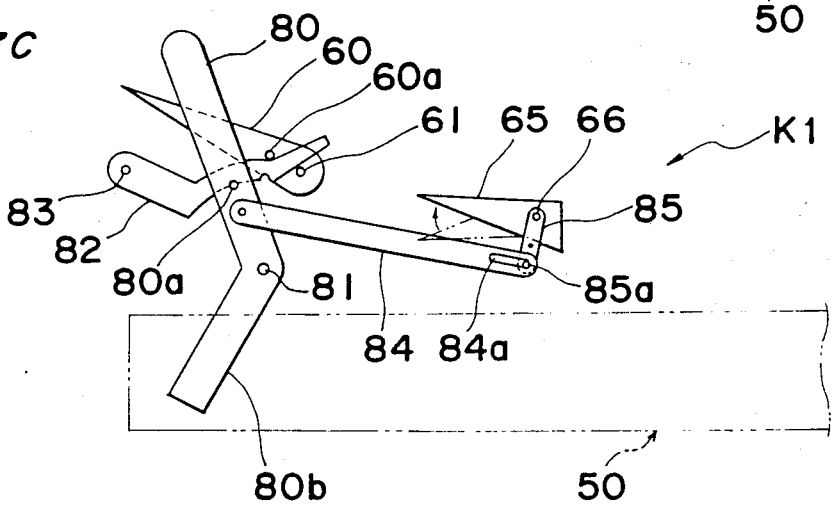
Figure 8A:
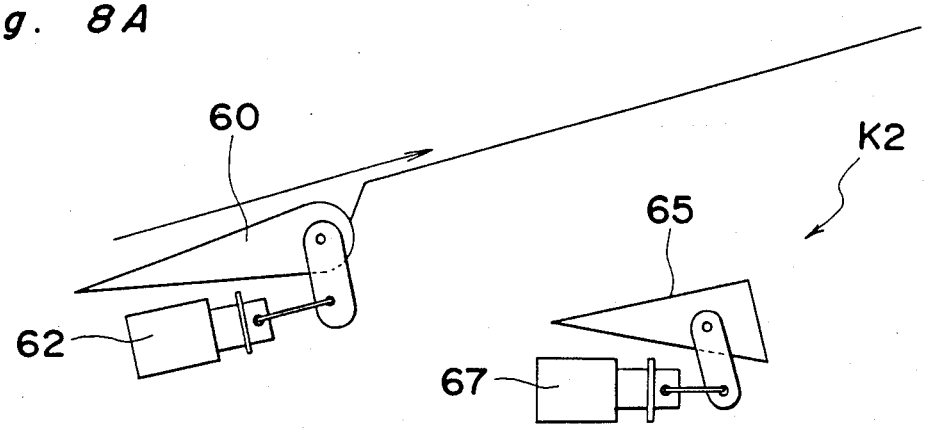
FIGS. 8A to 8C are views similar to FIGS. 7A to 7C, respectively, particularly showing changeover claws of a sheet refeeding device employed in a copying apparatus according to a second embodiment of the present invention.
Figure 8B:
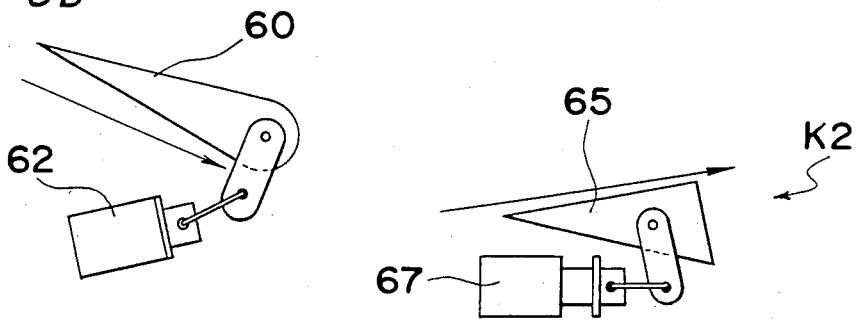
Figure 8C:
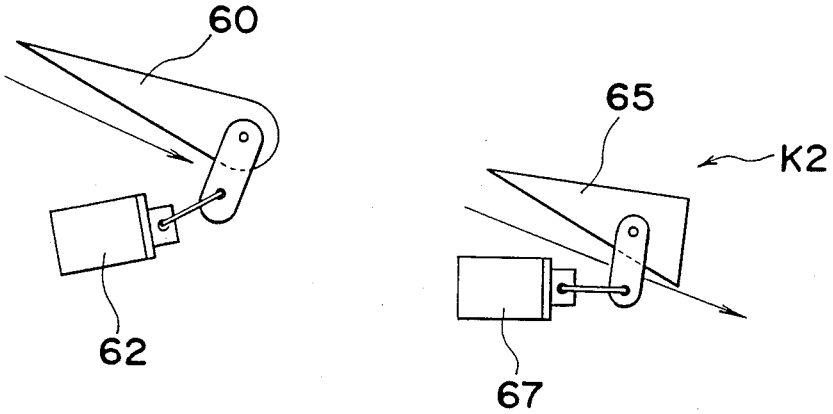

In order to change over the duplex copying mode to the composite copying mode, the operating lever 80 is further rotated to the position shown in FIG. 7C. At this time, the operating lever 80 is retained in position through engagement of the pin **80*a* with the recess 82*d* of the intermediate lever 82 such that the intermediate lever 82 is held at the same position as that of FIG. 7B, so that the first changeover claw 60 is also held at the upper position. At the same time, since the link 84 is further displaced leftwards by the operating lever 80, the link 85 is rotated in the clockwise direction together with the support shaft 65 and thus, the second changeover claw 65 is rotated to the upper position shown by the two-dot chain lines in FIG. 1. Meanwhile, the lower end portion 80*b* of the operating lever 80 is still projected into the passage of the sheet refeeding cassette 50, the sheet refeeding cassette 50 is still locked by the lower end portion 80*b* of the operating lever 80**.

As described above, in this embodiment, changeover of the sheet refeeding modes of the sheet refeeding device 30 can be performed simply by merely rotating the operating lever 80. In the duplex copying mode and the composite copying mode, the lower end portion **80*b* of the operating lever 80 is projected into the passage of the sheet refeeding cassette 50 so as to lock the sheet refeeding cassette 50 such that mounting and dismounting of the sheet refeeding cassette 50 are prevented by the lower end portion 80***b*. Hence, only when the operating lever 80 is set to the copy receiving tray mode, the sheet refeeding cassette 50 is withdrawable from the body portion 31.

Meanwhile, if solenoids are, respectively, coupled with the operating lever 80, the link 84, etc. such that the operating lever 80 is forcibly reset to the copy receiving tray mode upon turning on of the solenoids, the sheet refeeding device 30 is automatically changed over to the copy receiving tray mode at the time of occurrence of jam of the copy paper sheets, etc. and thus, the copy paper sheets fed after occurrence of the jam can be fed onto the copy receiving tray 45. Furthermore, if the solenoids are turned on when the number of the copy paper sheets detected by the sensor Se2 has reached a full capacity of the sheet refeeding cassette 50, such subsequent defective operations as jam of the copy paper sheets can be prevented beforehand. It can also be arranged that the sensor Se1 for detecting the sheet refeeding cassette 50 turns on the above described solenoids upon detection of withdrawal of the sheet refeeding cassette 50 so as to automatically change over the operating lever 80 to the copy receiving tray mode.

Meanwhile, in the case where the above described solenoids are turned on at the time when the trailing edge of the copy paper sheet has pressed by the first changeover claw 60, it becomes possible to prevent the copy paper sheet from being damaged by the first changeover claw 60.

Moreover, it can be also so arranged that when the copy paper sheets have been fed into the sheet refeeding cassette 50 to its full capacity, a state of full capacity of the sheet refeeding cassette 50 is displayed outwardly. In this case, it is convenient for the operator that preliminary display of the full capacity of the sheet refeeding cassette 50 is performed when the copy paper sheets fed into the sheet refeeding cassette 50 have reached a predetermined amount.

Hereinbelow, a copying apparatus K2 according to a second embodiment of the present invention is described with reference to FIGS. 8 to 18. The copying apparatus K2 is substantially the same, in construction, as the copying apparatus K1 and includes a solenoid 62 for changing over operations of the first changeover claw 60 and a solenoid 67 for changing over operations of the second changeover claw 65 so as to be controlled by a microcomputer CPU (FIG. 10). Since other constructions of the copying apparatus K2 are the same as those of the copying apparatus K1, the following description is given with reference to also FIGS. 1 to 6.

Turning on and off of the solenoids 62 and 67 in the sheet feeding modes are as follows. In the copy receiving tray mode, the solenoids 62 and 67 are in the off state such that both of the changeover claws 60 and 65 are disposed at the lower positions. In the duplex copying mode, the solenoid 62 is turned on such that the first changeover claw 60 is disposed at the upper position. In the composite copying mode, the solenoid 67 is also turned on such that the second changeover claw 65 is also disposed at the upper position.

Figure 9:
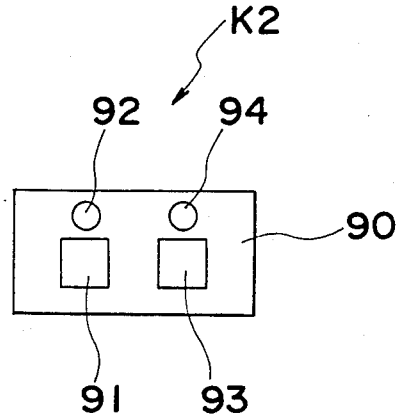
FIG. 9 is a top plan view of an operating panel employed in the copying apparatus of FIG. 8.
Figure 10:
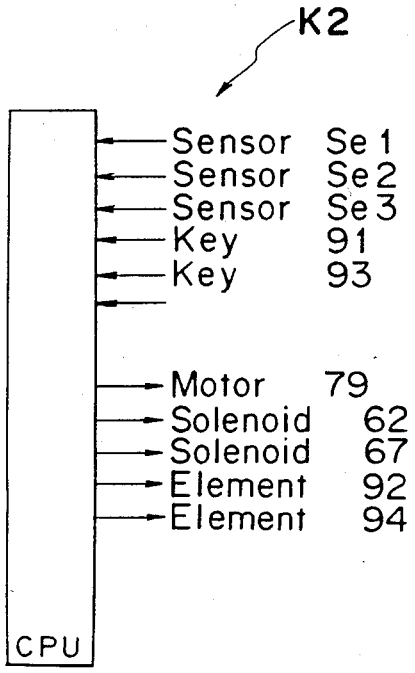
FIG. 10 is a block diagram of a control circuit of the copying apparatus of FIG. 8.

On the other hand, an operating panel 90 shown in FIG. 9 is provided on the body portion 31 and includes a key 91 for selecting the duplex copying mode, a key 93 for selecting the composite copying mode and light emitting elements 92 and 94 for indicating that the keys 91 and 93 have been selected, respectively. Selection of the keys 91 and 93 is effected upon first depression of the keys 91 and 93 and is cancelled upon second depression of the keys 91 and 93. When selection of both of the keys 91 and 93 is cancelled, the sheet refeeding device 30 is automatically changed over to the copying receiving tray mode.

FIG. 10 shows input and output ports of the microcomputer CPU. On-off signals of the sensors Se1 to Se3 and the keys 91 and 93 are applied to the input ports of the microcomputer CPU, while on-off signals of the motor 79, the solenoids 62 and 67 and the light emitting elements 92 and 94 are generated from the output ports of the microcomputer CPU.

Figure 11:
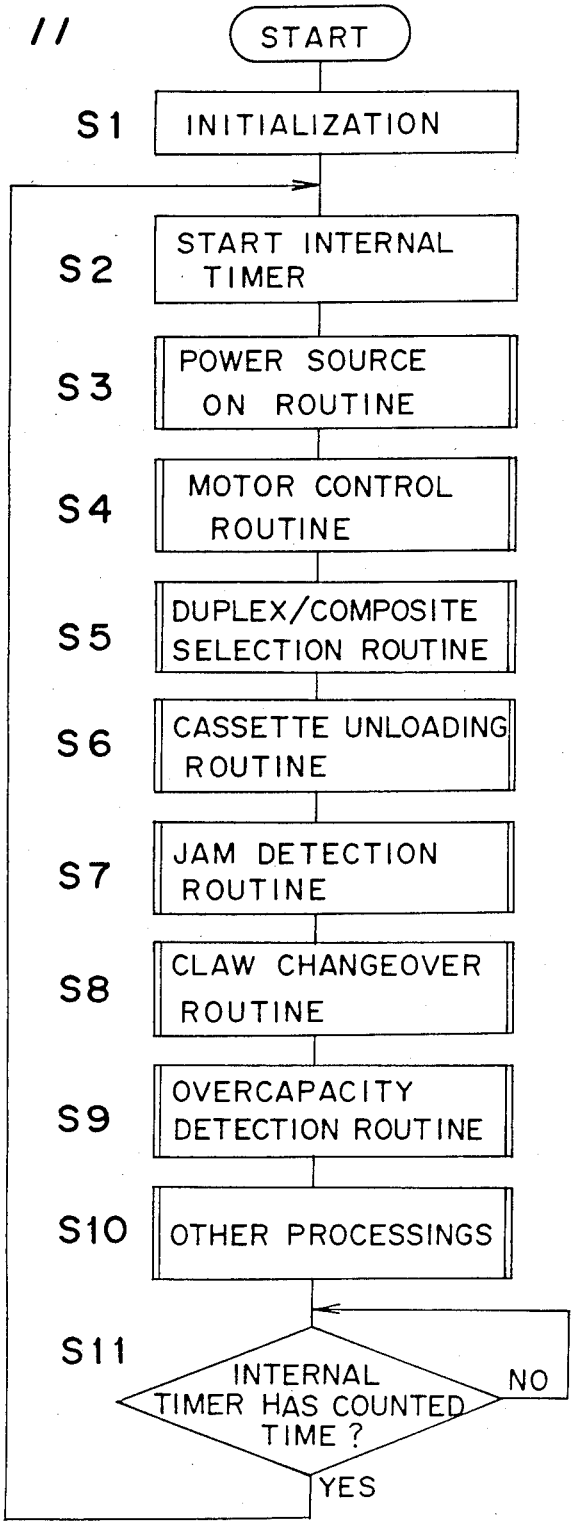
FIGS. 11 to 18 are flow charts showing processing sequences of operational control of the copying apparatus of FIG. 8.

Hereinbelow, processing sequences of operational control of the copying apparatus K2 are described with reference to flow charts of FIGS. 11 to 18. FIG. 11 shows a main routine of control of the copying apparatus K2. When the microcomputer CPU is started through its resetting upon turning on of a power source of the copying apparatus K2, initialization of various parameters is performed at step S1. Then, at step S2, an internal timer is started. This internal timer is reset at step S1 so as to determine a processing time of one cycle of this main routine. Respective timers to be described in subsequent subroutines judge lapse of their preset time periods on the basis of counts of the internal timer in one cycle of the main routine. Subsequently, subroutines are called at steps S3 to S10. After processing of all the subroutines of steps S3 to S10 has been completed, the program flow returns to step S2 upon lapse of the preset time period of the internal timer at step S11. Meanwhile, step S3 is a subroutine for executing a processiing to be performed in the case where the power source has been turned on, while step S4 is a subroutine for performing on-off control of the motor 79. Step S5 is a subroutine for executing a processing to be performed in the case where the duplex copying mode or the composite copying mode has been selected, while step S6 is a subroutine for executing a processing to be performed in the case where the sheet refeeding cassette 50 has been withdrawn from the body portion 31. Step S7 is a subroutine for executing a processing to be performed in the case where jam of the copy paper sheets has been detected, while step S8 is a subroutine for performing changeover of the changeover claws 60 and 65. Furthermore, step S9 is a subroutine for executing a processiing to be performed in the case where the copy paper sheets have been fed into the sheet refeeding cassette 50 to its full capacity, while step S10 is a subroutine for executing other processings.

Various flags to be used in the subsequent subroutines are as follows. An over-flag is a flag which is set to 1 when the number of the copy paper sheets fed into the sheet refeeding cassette 50 has exceeded 50 so as to indicate that the copy paper sheets have been fed into the sheet refeeding cassette 50 nearly to the full capacity. A jam flag is a flag which is set to 1 upon detection of jam of the copy paper sheets in the sheet refeeding device 30 so as to indicate occurrence of jam of the copy paper sheets. A jam changeover flag is a flag which is set to 1 upon occurrence of jam of the copy paper sheets so as to give an order of stop of drive of the motor 79. A changeover flag is a flag which is set to 1 upon occurrence of jam of the copy paper sheets or when the copy paper sheets have been fed into the sheet refeeding cassette 50 to the full capacity, etc. so as to give an order of changeover of the sheet feeding mode to the copy receiving tray mode.

Figure 12:
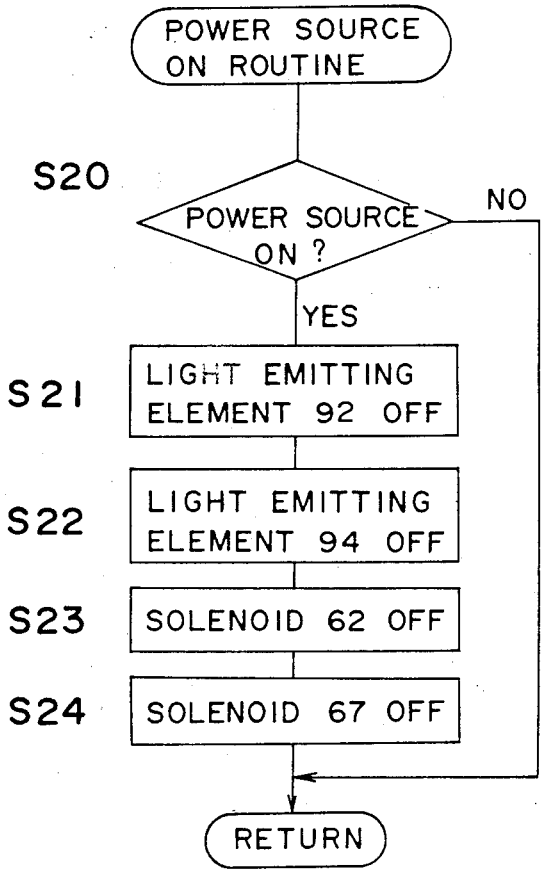

FIG. 12 shows step S3 of FIG. 11, i.e. the subroutine for executing the processing to be performed in the case where the power source has been turned on. In this subroutine, if it is found at step S20 that the power source has been turned on, the light emitting elements 92 and 94 are turned on at steps S21 and S22, respectively. Then, at steps S23 and S24, the solenoids 62 and 67 are turned off, respectively. Subsequently, the program flow returns to the main routine of FIG. 11.

Figure 13A:
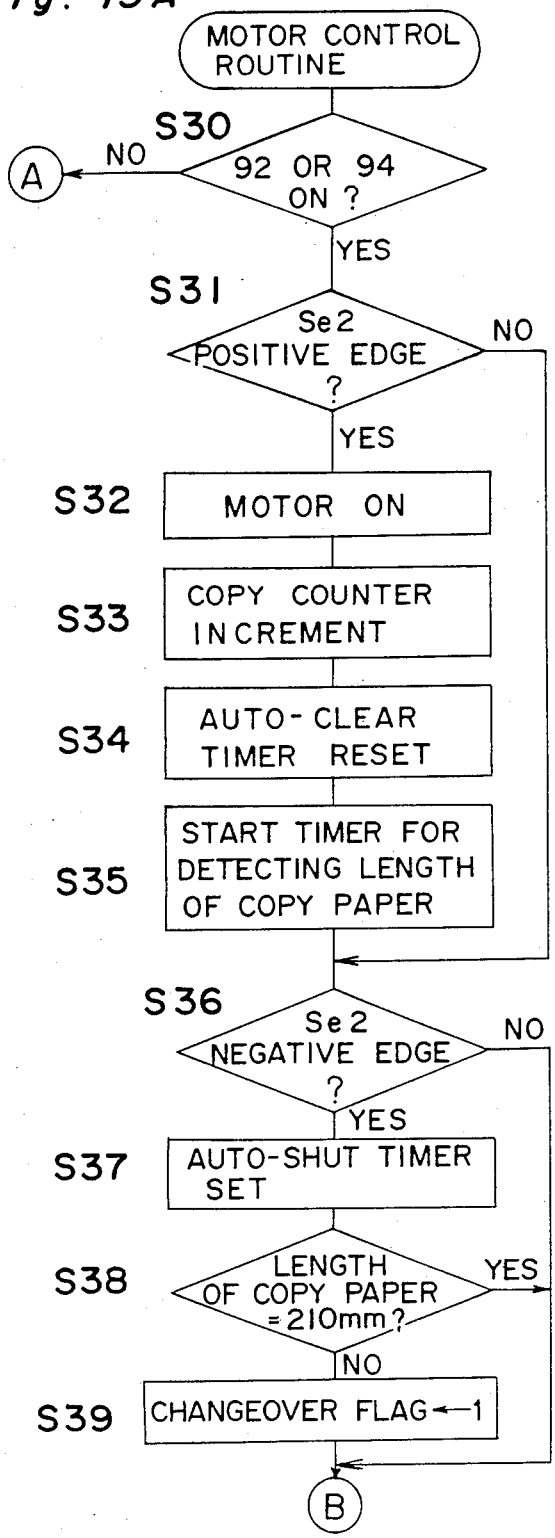
Figure 13B:
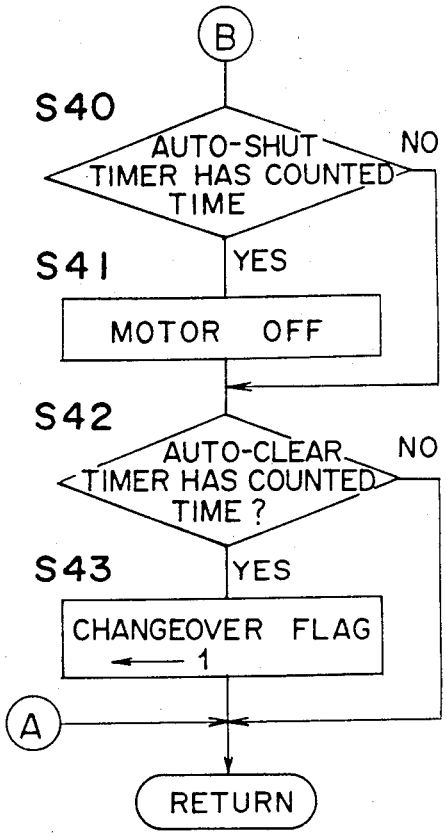

FIGS. 13A and 13B show step S4 of FIG. 11, i.e. the subroutine for performing on-off control of the motor 79. In this subroutine, a decision is initially made at step S30 as to whether or not the light emitting element 92 or 94 is in the on state. If the copy receiving tray mode has been selected, a decision of "NO" is made at step S30, so that the motor 79 is not required to be driven and thus, this subroutine is terminated immediately. On the contrary, if the duplex copying mode or the composite copying mode has been selected, a decision of "YES" is made at step S30. Then, at step S31, if positive edge of a pulse signal of the sensor Se2 is detected, namely the leading edge of the copy paper sheet is detected by the sensor Se2, the motor 79 is turned on at step S32 and thus, rotation of the rollers 71, 73, 76 and 34 is started. At the same time, a count of a copy counter for counting the number of the copied copy paper sheets is subjected to increment at step S33, an auto-clear timer is reset at step S34 and a copy length detecting timer for detecting length of the copy paper sheet is started at step S35.

Subsequently, at step S36, if negative edge of the copy paper sheet is detected, namely the trailing edge of the copy paper sheet is detected by the sensor Se2, an auto-shut timer is set at step S37 and then, at step S38, a decision as to whether or not the length of the copy paper sheet is 210 mm is made by the copy length detecting timer. This sheet refeeding cassette 50 is designed to be exclusively used for A4-sized sidewise feed in which sides of the A4-sized copy paper sheets (210×297 mm) are oriented at right angles to a feed direction of the A4-sized copy paper sheets. Thus, a decision as to whether or not the copy paper sheets discharged from the apparatus housing 1 are of A4-sized sidewise feed is made based on a width of 210 mm of the A4-sized copy paper sheets. If the copy paper sheets discharged from the apparatus housing 1 are not of A4-sized sidewise feed, a decision of "NO" is made at step S38 and then, the changeover flag is set to 1 at step S39. On the other hand, if the copy paper sheets discharged from the apparatus housing 1 are of A4-sized sidewise feed, a decision of "YES" is made at step S38. At this time, if it is found at step S40 that the auto-shut timer has counted its preset time period, the motor 79 is turned off at step S41. Then, if it is found at step S42 that the auto-clear timer has counted its preset time period, the changeover flag is set to 1 at step S43.

Namely, the preset time period of the auto-clear timer is so set as to be slightly larger than a sum of the copy length detecting timer and a time interval of transport of the copy paper sheets in a continuous copying mode. Meanwhile, the preset time period of the auto-shut timer is so set as to be slightly larger than the time interval of transport of the copy paper sheets in the continuous copying mode. Therefore, in the case where the copy paper sheets are continuously transported in the continuous copying mode, the copy length detecting timer is successively started at step 35 and thus, the motor 79 is not turned off. When a copy paper sheet in a single copying mode or the last copy paper sheet in the continuous copying mode has passed through the sensor Se2, the auto-shut timer is stopped for the first time and thus, the motor 79 is turned off at step S41. Meanwhile, when the copy paper sheets other than those of A4-sized sidewise feed are fed at step S38 or when the auto-clear timer has counted the preset time period at step S42, the changeover flag is set to 1 and gives an order of changeover of the sheet feeding mode to the copy receiving tray mode in the subsequent subroutines.

Figure 14A:
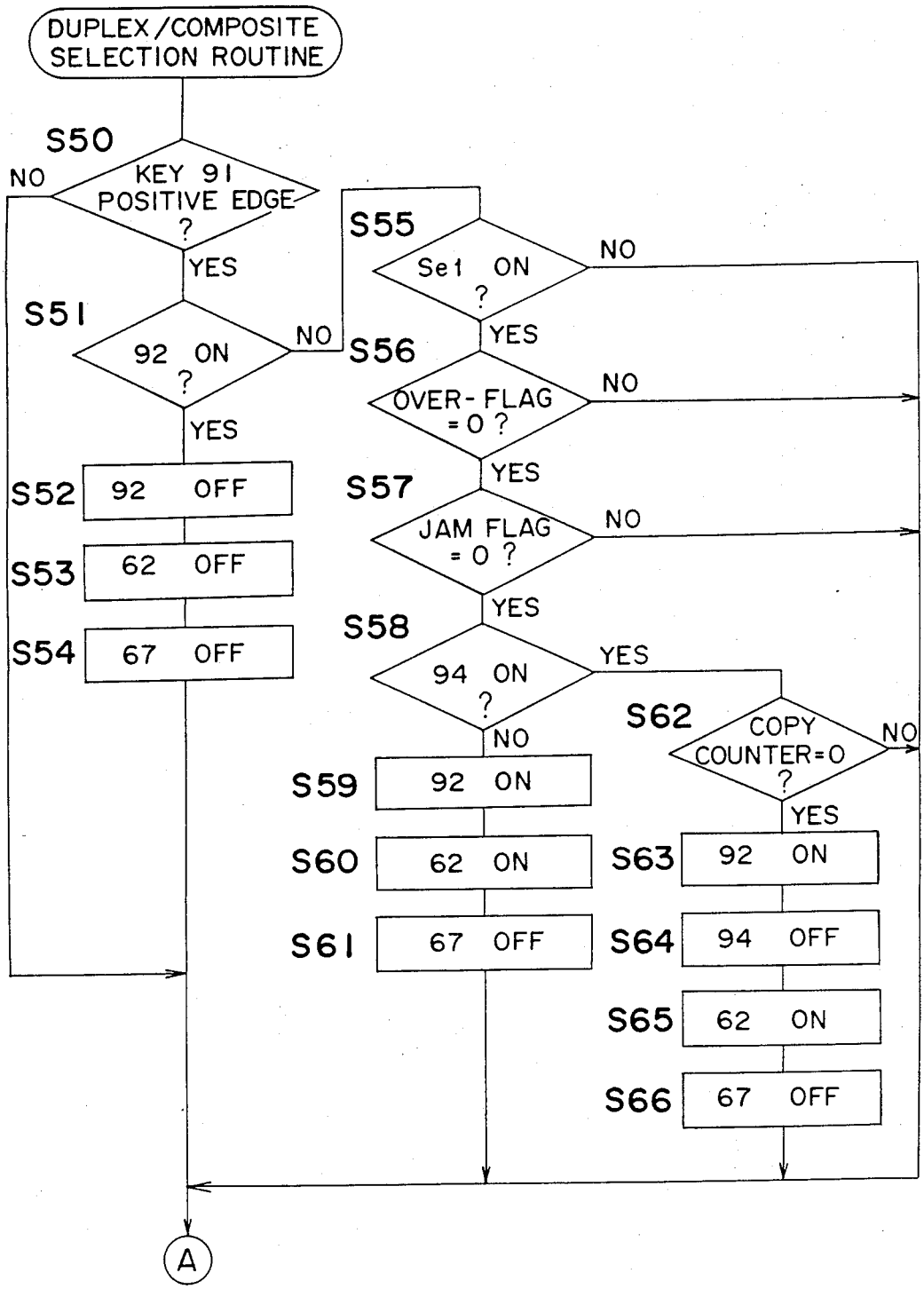
Figure 14B:
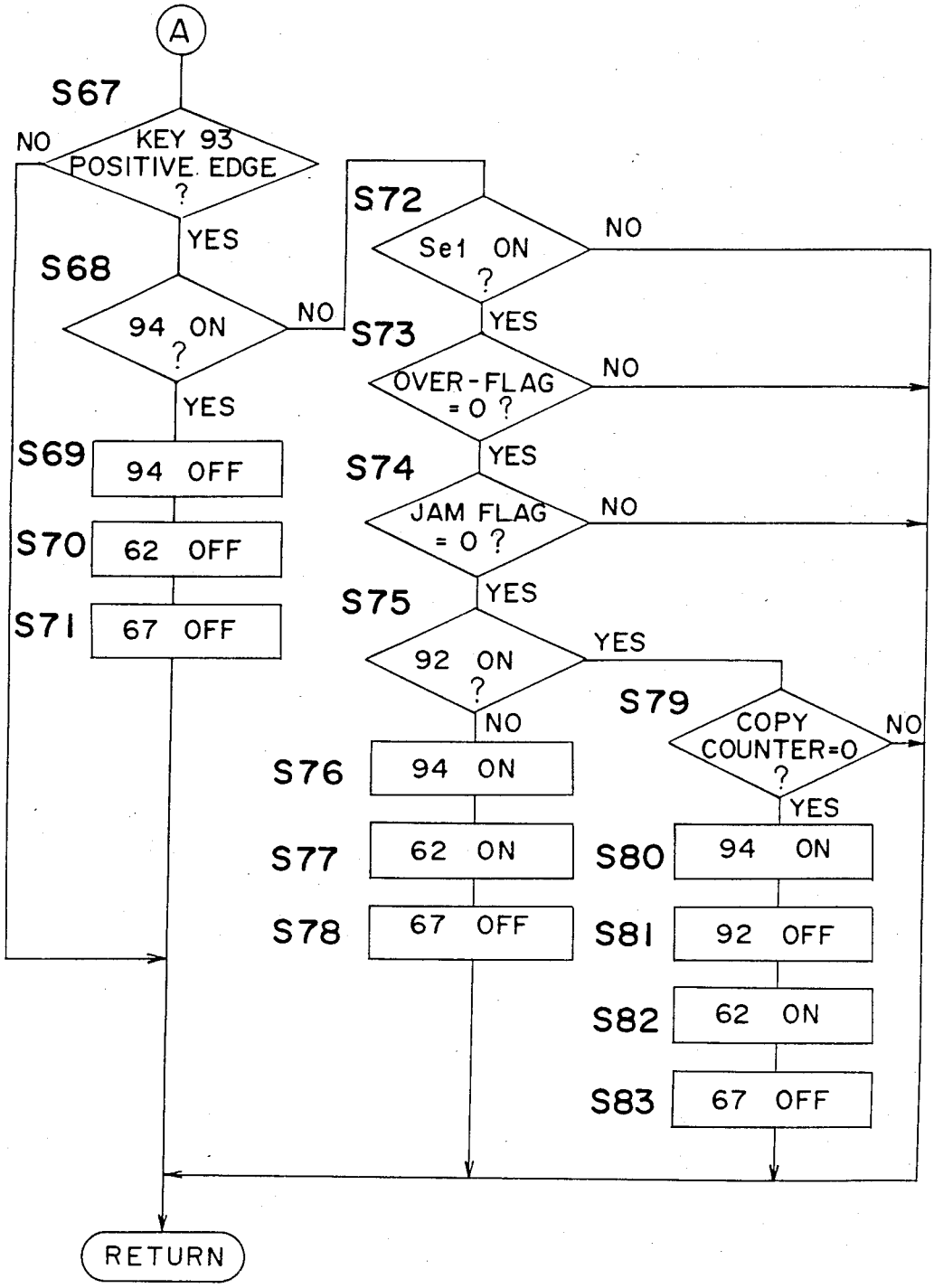

FIGS. 14A and 14B show step S5 of FIG. 11, i.e. the subroutine for executing the processing to be performed in the case where the duplex copying mode select key 91 or the composite copying mode select key 94 has been depressed. Initially, at step S50, a decision is made as to whether or not positive edge of a pulse signal of the key 91 is detected, namely the key 91 for selecting the duplex copying mode has been depressed. In the case of "YES" at step S50, a decision is made at step S51 as to whether or not the light emitting element 92 is turned on. In the case of "YES" at step S51, the duplex copying mode has been selected, so that the key 91 is in the on state upon second depression thereof and thus, a processing for cancelling the duplex copying mode is performed. Namely, the light emitting element 92 is turned off at step S92 and then, the solenoids 62 and 67 are turned off at steps S53 and S54, respectively.

Meanwhile, it is found at step S51 that the light emitting element 92 is turned off, the sheet feeding mode is changed over to the duplex copying mode after it has been found at step S55 that the sensor Se1 is turned on, at step S56 that the over-flag is zero and at step S57 that the jam flag is zero. It is to be noted that the sensor Se1 is provided for detecting loading of the sheet refeeding cassette 50 into the body portion 31 as described earlier.

Subsequently, at step S58, a decision is made as to whether or not the light emitting element 94 is turned on. This step is provided for judging whether or not the composite copying mode has been already selected. In the case of "NO" at step S58, the light emitting element 92 is turned on at step S59, the solenoid 62 is turned on at step S60 and then, the solenoid 67 is turned off at step S61 such that the sheet feeding mode is changed over to the duplex copying mode. If it is found at step S58 that the composite copying mode has been already selected, the sheet feeding mode is changed over to the duplex copying mode only if it is found at step S62 that the count of the copy counter is zero, namely no copy paper sheet has been fed into the sheet refeeding cassette 50. Namely, the light emitting element 92 is turned on at step S63, the light emitting element 94 is turned off at step S64, the solenoid 62 is turned on at step S65 and the solenoid 67 is turned off at step S66.

Meanwhile, steps S67 and thereafter are a subroutine for selecting the composite copying mode. At step S67, a decision is made as to whether or not positive edge of the key 93 for selecting the composite copying mode is detected. In the case of "YES" at step S67, a decision is made at step S68 as to whether or not the light emitting element 94 is turned on. If the light emitting element 94 has been already turned on, the key 93 is in the on state upon second depression thereof. Thus, in order to cancel the composite copying mode, the light emitting element 94 is turned off at step S69 and then, the solenoids 62 and 67 are turned off at steps S70 and S71, respectively. If it is found at step S68 that the light emitting element 94 is turned off, a decision is made at step S75 as to whether or not the light emitting element 92 is turned on after it has been found at step S72 that the sensor Se1 is turned on, at step S73 that the over-flag is zero and at step S74 that the jam flag is zero in the same manner as steps S55 to S57. If it is found at step S75 the light emitting element 92 is turned off, namely the the duplex copying mode is not selected, the light emitting element 94 is turned on at steps S76 and then, the solenoids 62 and 67 are turned on at steps S77 and S78, respectively such that the sheet feeding mode is changed over to the composite copying mode. On the other hand, even if the duplex copying mode has been already selected, i.e. in the case of "YES" at step S75, the sheet feeding mode is changed over to the composite copying mode if it is found at step S79 that the count of the copy counter is zero. Namely, the light emitting element 94 is turned on at step S80, the light emitting element 92 is turned off at step S81 and then, the solenoids 62 and 67 are turned on at steps S82 and S83, respectively.

Figure 15:
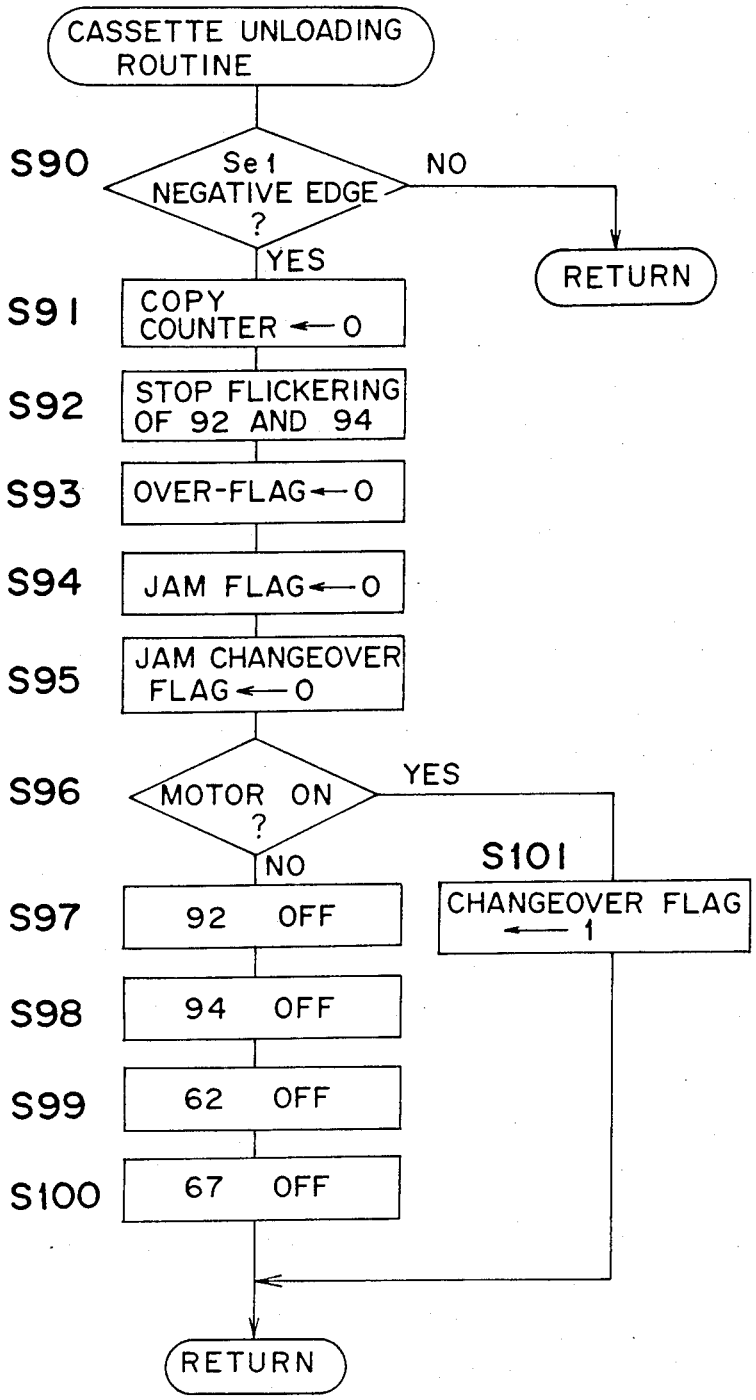

FIG. 15 shows step S6 of FIG. 11, i.e. the subroutine for executing the processing to be performed in the case where the sheet refeeding cassette 50 has been withdrawn from the body portion 31. Initially, at step S90, a decision is made as to whether or not negative edge of the sensor Se1 for detecting mounting and dismounting of the sheet refeeding cassette 50 is detected. In the case of "YES" at step S90, i.e. if it is found that the sheet refeeding cassette 50 has been withdrawn from the body portion 31, the copy counter is reset to 0 at step S91 and flickering of the light emitting elements 92 and 94 is stopped at step S92. This step S92 is provided for stopping flickering of the light emitting elements 92 and 94 to be executed later at steps S137 and S139. At the same time, the over-flag is reset to 0 at step S93, the jam flag is reset to 0 at step S94 and the jam changeover flag is reset to 0 at step S95.

Thereafter, a decision is made at step S96 as to whether or not the motor 79 is turned on. If it is found at step S96 that the motor 79 is not turned on, the light emitting elements 92 and 94 are turned off at steps S97 and S98, respectively and the solenoids 62 and 67 are turned off at steps S99 and S100, respectively. On the other hand, if it is found at step S96 that the motor 79 is in the on state, the changeover flag is set to 1 at step S101 and then, the program flow returns to the main routine. Namely, only if the motor 79 is turned off and no copy paper sheet is transported, the solenoids 62 and 67 are turned off such that the sheet feeding mode is changed over to the copy receiving tray mode. This is because the changeover claws 60 and 65 are switched to the upper positions upon turning on of the solenoids 62 and 67, thereby possibly resulting in damage to the copy paper sheets being transported. Thus, in the latter case, the changeover flag is set to 1 such that a processing for actuating the changeover claws 60 and 65 (changeover of the sheet feeding mode to the copy receiving tray mode) after passing of the copy paper sheets through the changeover claws 60 and 65 in the claw changeover routine to be described later is requested.

Figure 16:
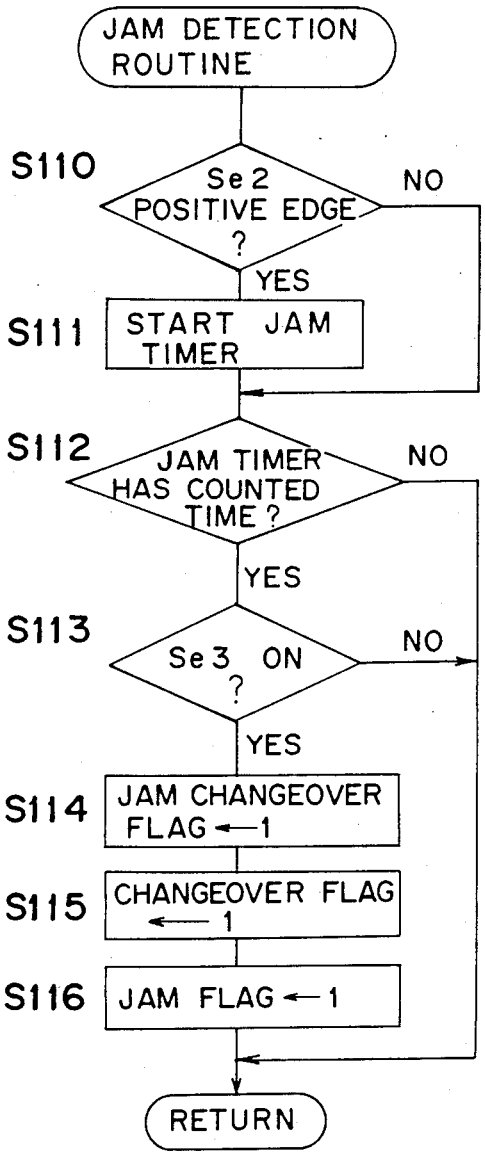

FIG. 16 shows step S7 of FIG. 11, i.e. the subroutine for detecting jam of the copy paper sheets. In this subroutine, if it is found initially at step S110 that positive edge of the sensor Se2 is detected, namely the leading edge of the copy paper sheet is detected by the sensor Se2, a jam timer is started at step S111. This jam timer is set to a time period during which the copy paper sheet is conveyed from the sensor Se2 to the sensor Se3 provided at the turnover position. When the jam timer has counted its preset time period at step S112 and when the sensor Se3 is still in the on state at step S113, jam of the copy paper sheets, e.g. winding of the copy paper sheets around the turnover roller 76 takes place. Thus, in this case, the jam changeover flag is set to 1 at step S114, the changeover flag is set to 1 at step S115 and the jam flag is set to 1 at step S116 and then, the program flow returns to the main routine.

Figure 17:
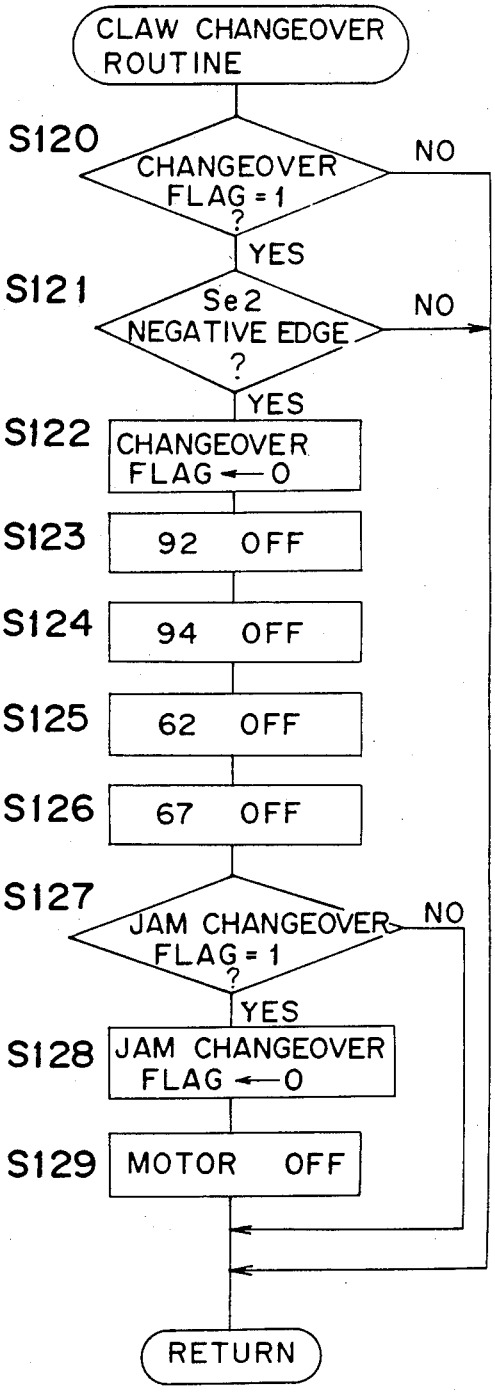

FIG. 17 shows step S8 of FIG. 11, i.e. the subroutine for performing changeover of the changeover claws 60 and 65. Initially, at step S120, a decision is made as to whether or not the changeover flag is 1. When an order of changeover of the changeover claws 60 and 65 has been given, a decision of "YES" is made at step S120. In this case, if negative edge of the copy paper sheet is detected, namely the trailing edge of the copy paper sheet has passed through the sensor Se2, the changeover flag is reset to 0 at step S122, the light emitting elements 92 and 94 are turned off at steps S123 and S124, respectively and then, the solenoids 62 and 67 are turned off at steps S125 and S126, respectively. This changeover is so set, in timing, as to be performed after passing of one copy paper sheet through the sensor Se2 and prior to transport of the next copy paper sheet to the sensor Se2. Then, a decision is made at step S127 as to whether or not the jam changeover flag is 1. When jam of the copy paper sheets takes place, a decision of "YES" is made at step S127. In this case, the jam changeover flag is reset to 0 at step S128 and then, the motor 79 is turned off at step S129.

Figure 18:
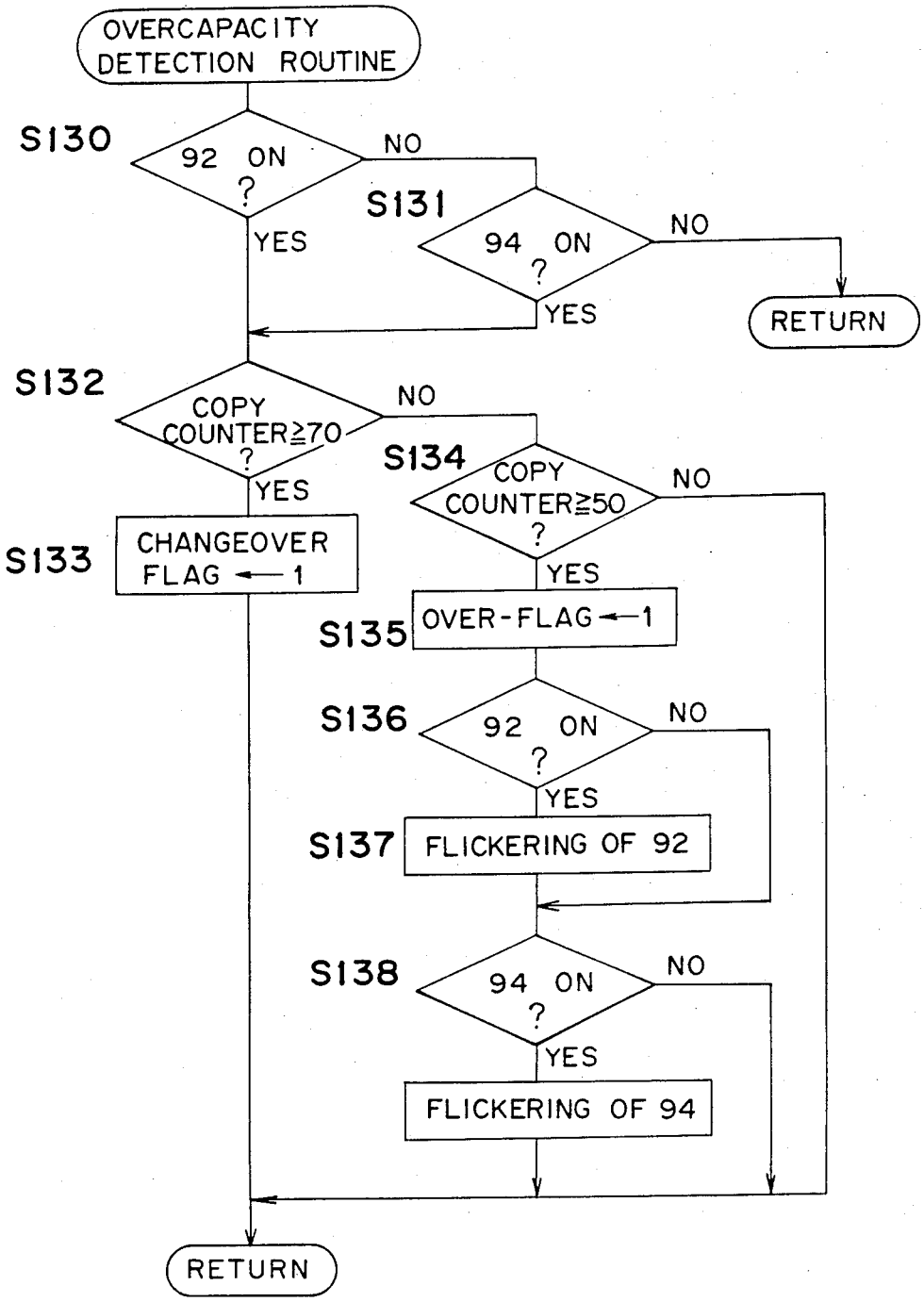

FIG. 18 shows step S9 of FIG. 11, i.e. the subroutine for detecting amount of the copy paper sheets fed into the sheet refeeding cassette 50. Initially, a decision is made at step S130 as to whether or not the light emitting element 92 is turned on and a decision is made at step S131 as to whether or not the light emitting element 94 is turned on. Namely, a decision is made at steps S130 and S131 as to whether or not either one of the duplex copying mode and the composite copying mode has been selected. In the case of "NO" at steps S130 and S131, the program flow returns to the main routine. In the case of "YES" at one of steps S130 and S131, a decision is made at step S132 as to whether or not the count of the copy counter is 70 or more. In the case of "NO" at step S132, a decision is likewise made at step S134 as to whether or not the count of the copy counter is 50 or more. In this embodiment, the full capacity of the sheet refeeding cassette 50 is set at 70. Thus, when the number of the copy paper sheets fed into the sheet refeeding cassette 50 has reached 50 in the neighborhood of 70, preliminary display indicative of impending reach of the full capacity of the sheet refeeding cassette 50 is performed by flickering of the light emitting elements 92 and 94. Hence, if it is found at step S134 that the amount of the copy paper sheets fed into the sheet refeeding cassette 50 has reached 50, the light emitting element 92 is flickered at step S137 after it has been found at step S136 that the light emitting element 92 is in the on state, namely the duplex copying mode is being selected. Meanwhile, if it is found at step S138 that the light emitting element 94 is in the on state, namely the composite copying mode is being selected, the light emitting element 94 is flickered at step S139.

On the other hand, if it is found at step S132 that the number of the copy paper sheets fed into the sheet refeeding cassette 50 had reached 70, the changeover flag is set to 1 at step S133 such that the processiing for actuating the changeover claws 60 and 65 (changeover of the sheet feeding mode to the copy receiving tray mode) after passing of the copy paper sheets through the changeover claws 60 and 65 is requested.

Figure 19:
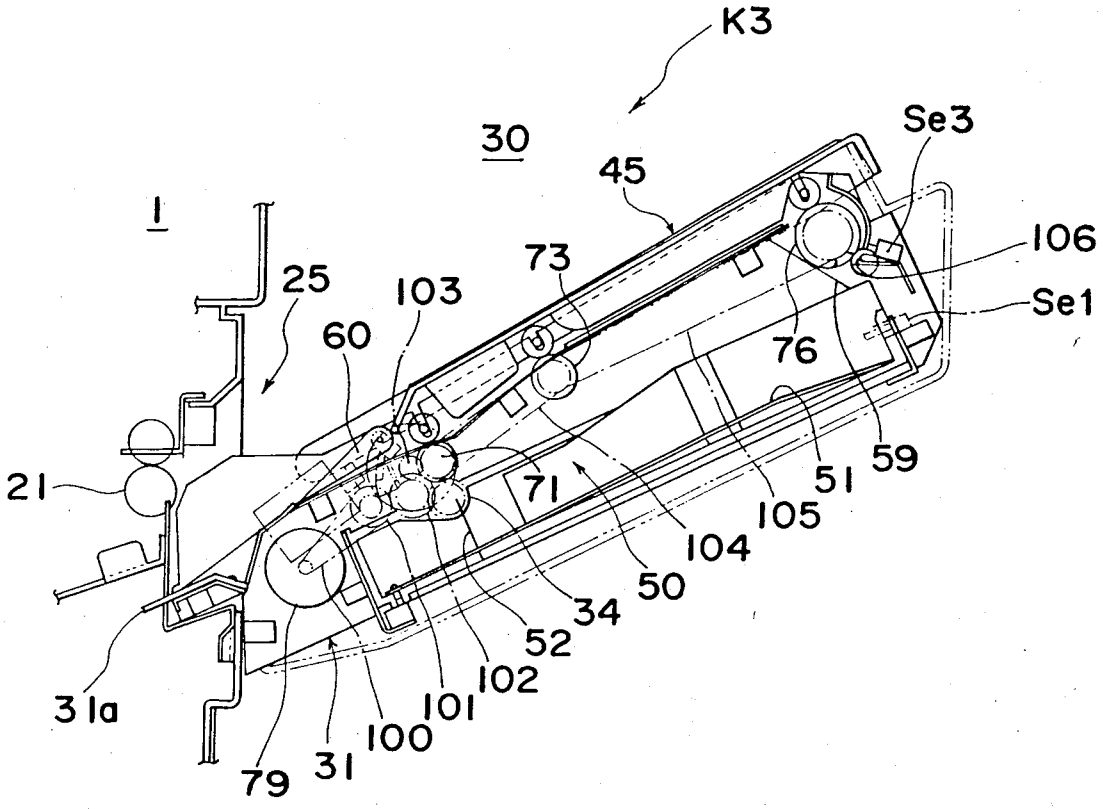
FIG. 19 is a fragmentary sectional view of a copying apparatus mounted with a sheet refeeding device, according to a third embodiment of the present invention.

Referring to FIG. 19, there is shown a copying apparatus K3 according to a third embodiment of the present invention. The copying apparatus K3 has a feed passage for turning over the copy paper sheets so as to be exclusively used for duplex copying. Thus, in the coping apparatus K3, the second changeover claw 65 of the copying apparatus K2 is not provided. Since other constructions of the copying apparatus K3 are the same as those of the copying apparatus K2, detailed description thereof is abbreviated for the sake of brevity. In FIG. 19, a drive unit of the sheet refeeding device 50 is illustrated in more details than that of the copying apparatus K2. Namely, a driving force of the motor 79 is transmitted to a gear 101 through a belt 100. Furthermore, the driving force of the motor 79 is transmitted not only to the press rollers 34 via an idle gear 102 but to the driving roller 71 through an idle gear 103. Meanwhile, the driving force of the motor 79 is transmitted to the driving roller 73 and the turnover roller 76 through belts 104 and 105, respectively. Meanwhile, a charge erasing brush 106 for removing static electricity carried to the copy paper sheets is provided in the vicinity of the turnover roller 76.

As is clear from the foregoing description, in accordance with the present invention, the copy receiving tray is provided on the body portion mounted detachably on the sheet ejecting portion of the copying apparatus and the sheet refeeding cassette is detachably mounted not only on the body portion but on the sheet feeding portion of the copying apparatus. Furthermore, the changeover means for changing over the feed passage of the copy paper sheets discharged from the apparatus housing, to the copy receiving tray and the sheet refeeding cassette.

Accordingly, in accordance with the present invention, the sheet refeeding cassette can be used not only as the means for receiving the copy paper sheets but as the means for feeding the copy paper sheets.

Furthermore, in accordance with the present invention, another copy receiving tray is not required to be provided additionally and the sheet refeeding device of the copying apparatus of the present invention can be conveniently mounted, as an option. on existing copying apparatuses having no sheet refeeding device.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A copying apparatus comprising:

a recording module which forms an image on copy paper sheets fed from a sheet feeding portion and discharges the copy paper sheets to a sheet ejecting portion; and a sheet processing module which is detachably mounted on said sheet ejecting portion; said sheet processing module comprising:

a sheet cassette for accommodating the copy paper sheets, which is detachably mounted on said sheet processing module and said sheet feeding portion;

a copy receiving tray; and a changeover means for changing over a passage of the copy paper sheets discharged from said sheet ejecting portion so as to guide the sheet to said sheet cassette or to said copy receiving tray.

2. A copying apparatus as claimed in claim 1, wherein a copied face of each of the copy paper sheets is discharged onto said copy receiving tray so as to be oriented upwardly and is discharged into said sheet cassette so as to be oriented downwardly.

3. A copying apparatus as claimed in claim 1, wherein said sheet processing module further includes a positioning means for setting said sheet cassette at a predetermined position.

4. A copying apparatus as claimed in claim 1, wherein said sheet cassette is detachably mounted on said sheet processing module in a direction perpendicular to a direction for discharging the copy paper sheets to said sheet ejecting portion.

5. A copying apparatus as claimed in claim 4, wherein said sheet cassette is detachably mounted on said sheet feeding portion in a direction for feeding the copy paper sheets from said sheet feeding portion.

6. A copying apparatus as claimed in claim 1, wherein said sheet cassette has a plate for placing thereon the copy paper sheets, which is movable upwardly and downwardly.

7. A copying apparatus as claimed in claim 6, wherein when said sheet cassette is mounted on said sheet processing module, said plate is disposed at a lowermost position.

8. A copying apparatus as claimed in claim 6, wherein when said sheet cassette is mounted on said sheet feeding portion, said plate is displaced to an upper position.

9. A copying apparatus comprising:

a recording module which forms an image on copy paper sheets fed from a sheet feeding portion and discharges the copy paper sheets to a sheet ejecting portion; and a sheet processing module which is detachably mounted on said sheet ejecting portion; said sheet processing module comprising:

a sheet cassette for accommodating the copy paper sheets, which is detachably mounted on said sheet processing module and said sheet feeding portion;

a copy receiving tray;

a changeover means for selectively feeding to said copy receiving tray or said sheet cassette, the copy paper sheets discharged from said sheet ejecting portion; and means for prohibiting withdrawal of said sheet cassette from a predetermined position of said sheet processing module when feeding of the copy paper sheets to said sheet cassette is selected by said changeover means.

10. A copying apparatus as claimed in claim 9, wherein said means is displaced in response to displacement of said changeover means.

11. A copying apparatus as claimed in claim 10, wherein said means is projected into a passage for withdrawing said sheet cassette from said sheet processing module when feeding of the copy paper sheets to said sheet cassette is selected by said changeover means.

12. A copying apparatus comprising:

a recording module which forms an image on copy paper sheets fed from a sheet feeding portion and discharges the copy paper sheets to a sheet ejecting portion; and a sheet processing module which is detachably mounted on said sheet ejecting portion; said sheet processing module comprising:

a sheet cassette for accommodating the copy paper sheets, which is detachably mounted on said sheet processing module and said sheet feeding portion;

a first passage for feeding the copy paper sheets into said sheet cassette such that a copied face of each of the copy paper sheets is oriented upwardly;

a second passage for feeding the copy paper sheets into said sheet cassette such that the copied face of each of the copy paper sheets is oriented downwardly; and a changeover means for performing changeover of a feed passage of the copy paper sheets between said first passage and said second passage.

13. A copying apparatus as claimed in claim 12, wherein said sheet processing module further includes a positioning means for setting said sheet cassette at a predetermined position.

14. A copying apparatus as claimed in claim 13, wherein said sheet cassette is detachably mounted on said sheet processing module in a direction perpendicular to a direction for discharging the copy paper sheets to said sheet ejecting portion.

15. A copying apparatus as claimed in claim 14, wherein said sheet cassette is detachably mounted on said sheet feeding portion in a direction for feeding the copy paper sheets from said sheet feeding portion.

16. A copying apparatus as claimed in claim 12, wherein said sheet cassette has a plate for placing thereon the copy paper sheets, which is movable upwardly and downwardly.

17. A copying apparatus as claimed in claim 16, wherein said sheet cassette is mounted on said sheet processing module, said plate is disposed at a lowermost position.

18. A copying apparatus as claimed in claim 16, wherein said sheet cassette is mounted on said sheet feeding portion, said plate is displaced to an upper position.

19. A copying apparatus comprising:

a recording module which forms an image on copy paper sheets fed from a sheet feeding portion and discharges the copy paper sheets to a sheet ejecting portion; and a sheet processing module which is detachably mounted on said sheet ejecting portion; said sheet processing module comprising:

a copy receiving tray;

a sheet cassette for accommodating the copy paper sheets, which is detachably mounted on said sheet processing module and said sheet feeding portion;

a first passage for feeding into said sheet cassette, the copy paper sheets discharged from said sheet ejecting portion such that a copied face of each of the copy paper sheets is oriented in a first direction;

a second passage for feeding into said sheet cassette, the copy paper sheets discharged from said sheet ejecting portion such that the copied face of each of the copy paper sheets is oriented in a second direction different from the first direction; and a changeover means for feeding the copy paper sheets discharged from said sheet ejecting portion to one of said copy receiving tray, said first passage and said second passage.

20. A copying apparatus as claimed in claim 19, wherein said copy receiving tray has an upper face for placing thereon the copy paper sheets and a lower face for defining a portion of said first passage.

21. A copying apparatus as claimed in claim 20, wherein said copy receiving tray is formed by a transparent member.

22. A copying apparatus as claimed in claim 20, wherein said copy receiving tray is detachably mounted on said sheet processing module.

23. A copying apparatus as claimed in claim 19, wherein said changeover means includes a first changeover claw for changing over to said copy receiving tray or said sheet cassette, a discharge direction of the copy paper sheets discharged from said sheet ejecting portion and a second changeover claw for changing over to said first passage or said second passage, a discharge direction of the copy paper sheets discharged towards said sheet cassette.

24. A copying apparatus comprising:

a recording module which forms an image on copy paper sheets fed from a sheet feeding portion and discharges the copy paper sheets to a sheet ejecting portion; and a sheet processing module which is detachably mounted on said sheet ejecting portion; said sheet processing module comprising:

a copy receiving tray;

a sheet cassette for accommodating the copy paper sheets, which is detachably mounted on said sheet processing module and said sheet feeding portion;

a first passage for feeding into said sheet cassette, the copy paper sheets discharged from said sheet ejecting portion such that a copied face of each of the copy paper sheets is oriented in a first direction;

a second passage for feeding into said sheet cassette, the copy paper sheets discharged from said sheet ejecting portion such that the copied face of each of the copy paper sheets is oriented in a second direction different from the first direction;

a changeover means for feeding the copy paper sheets discharged from said sheet ejecting portion to one of said copy receiving tray, said first passage and said second passage; and means for prohibiting withdrawal of said sheet cassette from said sheet processing module when said first passage or said second passage is selected by said changeover means.

25. A copying apparatus as claimed in claim 24, wherein said changeover means includes a first changeover claw for changing over to said copy receiving tray or said sheet cassette, a discharge direction of the copy paper sheets discharged from said sheet ejecting portion, a second changeover claw for changing over to said first passage or said second passage, a discharge direction of the copy paper sheets discharged towards said sheet cassette and a single operating lever for actuating said first changeover claw and said second changeover claw.

26. A copying apparatus as claimed in claim 25, wherein said means is displaced in response to displacement of said operating lever.

27. A copying apparatus as claimed in claim 26, wherein said means is projected into a passage for withdrawing said sheet cassette from said sheet processing module when feeding of the copy paper sheets to said sheet cassette is selected by said changeover means.

* * * * *